US008200398B2

(12) United States Patent
Sahlin et al.

(10) Patent No.: US 8,200,398 B2
(45) **Date of Patent: *Jun. 12, 2012**

(54) AUTOMATED CONTROL OF BOOM AND ATTACHMENT FOR WORK VEHICLE

(75) Inventors: Mark Peter Sahlin, Bettendorf, IA (US); Jason Meredith, Tuscola, IL (US); Jerry Anthony Samuelson, Lynn Center, IL (US); David August Johnson, Moline, IL (US); Eric Richard Anderson, Galena, IL (US)

(73) Assignee: Deere & Company, Moline, IL (US)

( * ) Notice: Subject to any disclaimer, the term of this patent is extended or adjusted under 35 U.S.C. 154(b) by 949 days.

This patent is subject to a terminal disclaimer.

(21) Appl. No.: 11/828,796

(22) Filed: Jul. 26, 2007

(65) Prior Publication Data

US 2009/0018729 A1 Jan. 15, 2009

Related U.S. Application Data

(60) Provisional application No. 60/890,927, filed on Feb. 21, 2007.

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |

(52) U.S. Cl. ..... 701/50; 37/416; 414/694; 414/699

(58) Field of Classification Search ..... 701/50, 701/82, 91, 28; 172/4.5; 60/419, 445; 37/348, 37/379, 382, 396, 414, 416, 907; 414/699, 414/694

See application file for complete search history.

(56) References Cited

U.S. PATENT DOCUMENTS 3,643,828 A 2/1972 Elliott
4,737,705 A * 4/1988 Bitar et al. ..... 324/635

(Continued)

FOREIGN PATENT DOCUMENTS

GB 2243359 A * 10/1991

OTHER PUBLICATIONS

USPTO Office Action regarding U.S. Appl. No. 11/828,737, dated Aug. 17, 2010, 12 pages.

(Continued)

*Primary Examiner* — Khoi Tran
*Assistant Examiner* — Jamie Figueroa
(74) *Attorney, Agent, or Firm* — Yee & Associates, P.C.; Jeremy J. Westlake

(57) ABSTRACT

A first sensor detects a boom position of a boom based on a first linear position of a first movable member of a first hydraulic cylinder. A second sensor detects an attachment position of an attachment based on a second linear position of a second movable member of a second hydraulic cylinder. An accelerometer detects an acceleration or deceleration of the boom. A switch accepts a command to enter a ready position state from another position state. A controller controls the first hydraulic cylinder to attain a target boom position and for controlling the second cylinder to attain a target attachment position associated with the ready position state in response to the command in conformity with at least one of a desired boom motion curve and a desired attachment motion curve.

27 Claims, 11 Drawing Sheets

U.S. PATENT DOCUMENTS

| | | | | | |
|---|---|---|---|---|---|
| 4,844,685 | A | * | 7/1989 | Sagaser | 414/700 |
| 4,864,746 | A | | 9/1989 | Fukumoto | |
| 5,000,650 | A | | 3/1991 | Brewer et al. | |
| 5,160,239 | A | * | 11/1992 | Allen et al. | 414/699 |
| 5,217,126 | A | * | 6/1993 | Hayashi et al. | 212/277 |
| 5,257,177 | A | * | 10/1993 | Bach et al. | 700/61 |
| 5,361,211 | A | * | 11/1994 | Lee et al. | 701/50 |
| 5,490,081 | A | * | 2/1996 | Kuromoto et al. | 700/178 |
| 5,528,843 | A | | 6/1996 | Rocke | |
| 5,572,809 | A | * | 11/1996 | Steenwyk et al. | 37/348 |
| 5,598,648 | A | * | 2/1997 | Moriya et al. | 37/348 |
| 5,701,691 | A | * | 12/1997 | Watanabe et al. | 37/348 |
| 5,704,141 | A | * | 1/1998 | Miura et al. | 37/348 |
| 5,826,666 | A | * | 10/1998 | Tozawa et al. | 172/7 |
| 5,890,870 | A | * | 4/1999 | Berger et al. | 414/699 |
| 5,899,008 | A | | 5/1999 | Cobo et al. | |
| 5,903,988 | A | * | 5/1999 | Tochizawa et al. | 37/348 |
| 5,909,116 | A | * | 6/1999 | Jin et al. | 324/207.24 |
| 5,953,977 | A | * | 9/1999 | Krishna et al. | 91/361 |
| 5,968,103 | A | * | 10/1999 | Rocke | 701/50 |
| 5,968,104 | A | * | 10/1999 | Egawa et al. | 701/50 |
| 5,974,352 | A | | 10/1999 | Shull | |
| 6,064,933 | A | | 5/2000 | Rocke | |
| 6,115,660 | A | | 9/2000 | Berger et al. | |
| 6,205,687 | B1 | | 3/2001 | Rocke | |
| 6,211,471 | B1 | | 4/2001 | Rocke et al. | |
| 6,233,511 | B1 | * | 5/2001 | Berger et al. | 701/50 |
| 6,282,453 | B1 | | 8/2001 | Lombardi | |
| 6,317,669 | B1 | * | 11/2001 | Kurenuma et al. | 701/50 |
| 6,321,153 | B1 | | 11/2001 | Rocke et al. | |
| 6,357,132 | B1 | * | 3/2002 | Banks | 33/700 |
| 6,371,214 | B1 | * | 4/2002 | Anwar et al. | 172/1 |
| 6,496,766 | B1 | * | 12/2002 | Bernold et al. | 701/50 |
| 6,691,437 | B1 | * | 2/2004 | Yost et al. | 37/348 |
| 6,879,899 | B2 | | 4/2005 | Budde | |
| 6,968,241 | B2 | * | 11/2005 | Vonnoe et al. | 700/61 |
| 7,752,778 | B2 | | 7/2010 | Schoenmaker et al. | |
| 7,752,779 | B2 | | 7/2010 | Schoenmaker et al. | |
| 7,797,860 | B2 | | 9/2010 | Schoenmaker et al. | |
| 7,853,384 | B2 | * | 12/2010 | Johnson et al. | 701/50 |
| 7,894,962 | B2 | | 2/2011 | Sahlin et al. | |
| 8,065,060 | B2 | | 11/2011 | Danko | |
| 2002/0008075 | A1 | * | 1/2002 | Handroos et al. | 212/276 |
| 2003/0001751 | A1 | * | 1/2003 | Ogura et al. | 340/691.6 |
| 2004/0055455 | A1 | * | 3/2004 | Tabor et al. | 91/433 |
| 2005/0011190 | A1 | * | 1/2005 | Bitter | 60/468 |
| 2005/0242332 | A1 | * | 11/2005 | Ueki et al. | 254/277 |
| 2006/0038556 | A1 | * | 2/2006 | Low et al. | 324/207.24 |
| 2006/0192552 | A1 | * | 8/2006 | Low et al. | 324/207.22 |
| 2006/0232268 | A1 | * | 10/2006 | Arns et al. | 324/207.13 |
| 2007/0168100 | A1 | * | 7/2007 | Danko | 701/50 |
| 2008/0199294 | A1 | | 8/2008 | Sahlin et al. | |
| 2009/0018728 | A1 | | 1/2009 | Sahlin et al. | |
| 2009/0222176 | A1 | | 9/2009 | Florean et al. | |

OTHER PUBLICATIONS

USPTO Notice of Allowan ce regarding U.S. Appl. No. 11/828,737, dated Dec. 28, 2010, 4 pages.

USPTO Office Action regarding U.S. Appl. No. 11/828,760, dated Oct. 12, 2010, 21 pages.

USPTO Final Office Action regarding U.S. Appl. No. 11/828,760, dated Mar. 1, 2011, 17 pages.

USPTO Office Action regarding U.S. Appl. No. 11/828,760, dated Jun. 10, 2011, 11 pages.

USPTO Notice of Allowance regarding U.S. Appl. No. 11/828,760, dated Jan. 3, 2012, 7 pages.

USPTO Office Action regarding U.S. Appl. No. 11/828,778, dated Jul. 19, 2010, 15 pages.

USPTO Final Office Action regarding U.S. Appl. No. 11/828,778, dated Dec. 22, 2010, 20 pages.

USPTO Supplemental Final Office Action regarding U.S. Appl. No. 11/828,778, dated Feb. 15, 2011, 21 pages.

* cited by examiner

AUTOMATED CONTROL OF BOOM AND ATTACHMENT FOR WORK VEHICLE

This document (including the drawings) claims priority based on U.S. provisional application No. 60/890,927, filed on Feb. 21, 2007 and entitled AUTOMATED CONTROL OF BOOM AND ATTACHMENT FOR WORK VEHICLE, under 35 U.S.C. 119(e).

FIELD OF THE INVENTION

This invention relates to an automated control of a boom and attachment for a work vehicle.

BACKGROUND OF THE INVENTION

A work vehicle may be equipped for a boom and attachment attached to the boom. A work task may require repetitive or cyclical motion of the boom or the attachment. Where limit switches or two-state position sensors are used to control the motion of the boom or attachment, the work vehicle may produce abrupt or jerky movements in automated positioning of the boom or attachment. The abrupt or jerky movements produce unwanted vibrations and shock that tend to reduce the longevity of hydraulic cylinders and other components. Further, the abrupt or jerky movements may annoy an operator of the equipment. Accordingly, there is need to reduce or eliminate abrupt or jerky movements in automated control of the boom, attachment, or both.

In the context of a loader as the work vehicle where the attachment is a bucket, an automated control system may return the bucket to a ready-to-dig position or generally horizontal position after completing an operation (e.g., dumping material in the bucket). However, the control system may not be configured to align a boom to a desired boom height. Thus, there is a need for a control system that simultaneously supports movement of the attachment (e.g., bucket) and the boom to a desired position (e.g., ready-to-dig position).

SUMMARY OF THE INVENTION

A method and system for automated operation of a work vehicle comprises a boom having a first end and a second end opposite the first end. A first hydraulic cylinder is associated with the boom. A first sensor detects a boom position of a boom based on a first linear position of a first movable member of the first hydraulic cylinder. An attachment is coupled to the second end of the boom. A second hydraulic cylinder is associated with the attachment. A second sensor detects an attachment position of the attachment based on a second linear position of a second movable member of the second hydraulic cylinder. An accelerometer detects an acceleration or deceleration of the boom. A switch accepts a command to enter a ready position state from another position state. A controller controls the first hydraulic cylinder to attain a target boom position and for controlling the second cylinder to attain a target attachment position associated with the ready position state in response to the command in conformity with at least one of the desired boom motion curve and a desired attachment motion curve.

BRIEF DESCRIPTION OF THE DRAWINGS

Like reference numbers in different drawings indicate like elements, steps or procedures.

DESCRIPTION OF THE PREFERRED EMBODIMENT

Figure 1:
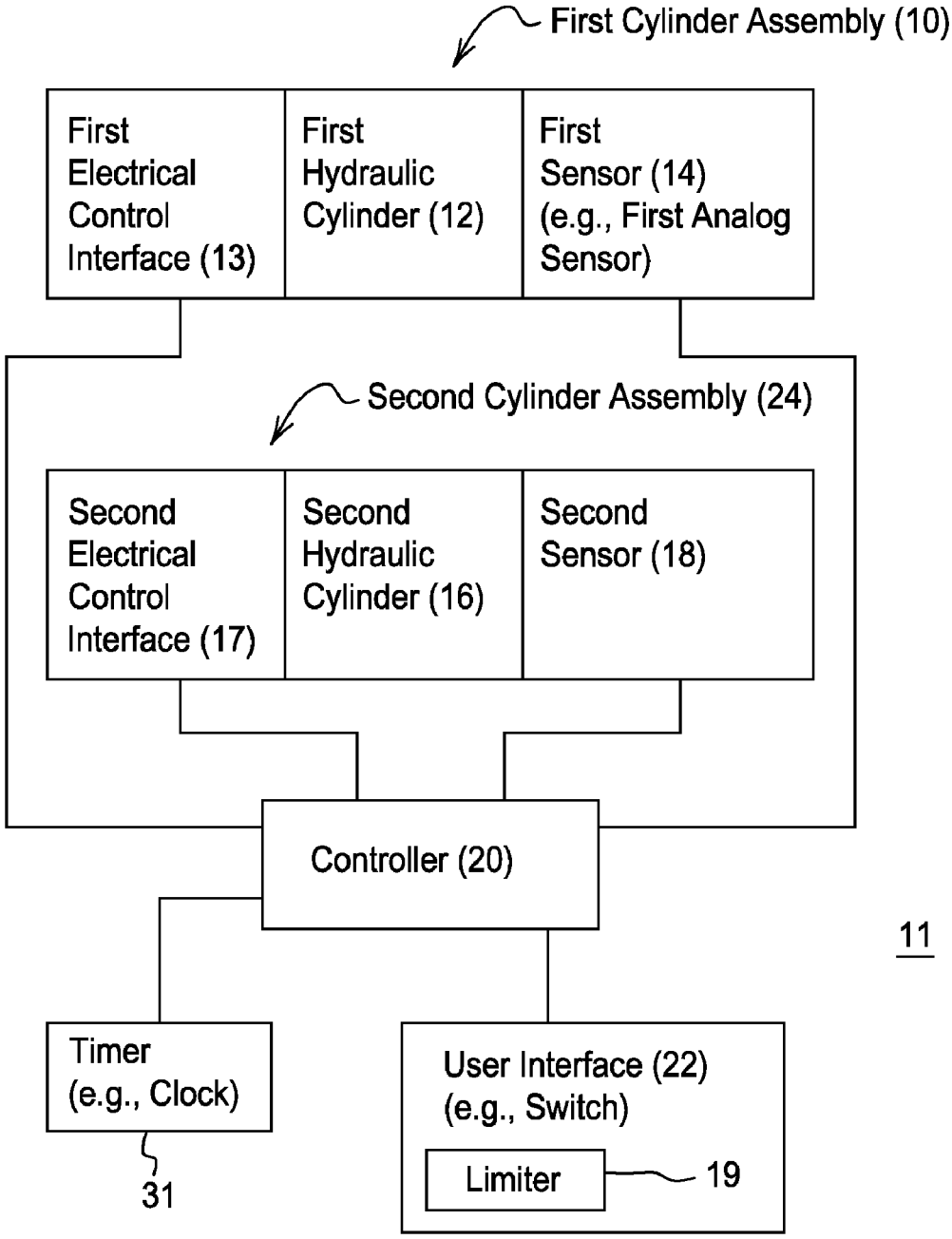
FIG. 1 is a block diagram of one embodiment of a control system for a boom and an attachment of a work vehicle.

In accordance with one embodiment, FIG. 1 illustrates a control system 11 for automated operation of a work vehicle. The control system 11 comprises a first cylinder assembly 10 and a second cylinder assembly 24 that provide a sensor signal or sensor data to a controller 20. The first cylinder assembly 10 comprises the combination of a first hydraulic cylinder 12, a first sensor 14, and a first electrical control interface 13. Similarly, the second cylinder assembly 24 comprises the combination of a second hydraulic cylinder 16, a second sensor 18, and a second electrical control interface 17. A timer 31 (e.g., clock) provides a time reference or pulse train to the controller 20 such that control data or control signals to the first electrical control interface 13 and the second electrical control interface 17 are properly modulated or altered over time to attain proper or desired movement of the attachment, the boom, or both. The controller 20 communicates with a user interface 22. The user interface 22 comprises a switch, a joystick, a keypad, a control panel, a keyboard, a pointing device (e.g., mouse or trackball) or another device that supports the operator's input and/or output of information from or to the control system 11.

Figure 2:
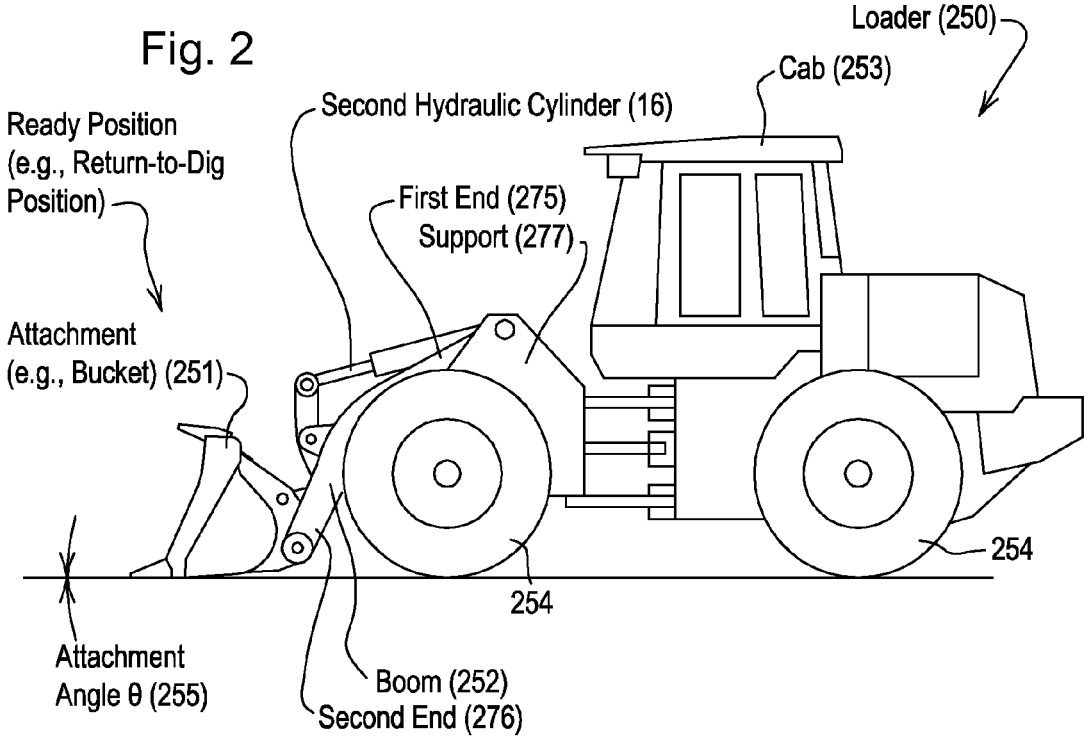
FIG. 2 is a diagram of a side view of a loader as an illustrative work vehicle, where the loader is in one ready position (e.g., return-to-dig position).

In accordance with FIG. 1 and FIG. 2, a boom 252 has a first end 275 and a second end 276 opposite the first end 275. The first hydraulic cylinder 12 is associated with the boom. The first hydraulic cylinder 12 is arranged to move the boom 252 by changing a position (e.g., first linear position) of a first movable member (e.g., rod or piston) of the first hydraulic cylinder 12. To move the boom 252 or hold the boom 252 steady in a desired position, the controller 20 sends a control signal or control data to the first electrical control interface 13. The first electrical control interface 13 may comprise an electromechanical valve, an actuator, a servo-motor, a solenoid or another electrically controlled device for controlling or regulating hydraulic fluid associated with the first hydraulic cylinder 12. The first sensor 14 detects a boom angle of a boom 252 with respect to a support (or vehicle) or detects the first linear position of a first movable member associated with the first hydraulic cylinder 12. An attachment (e.g., bucket 251) is coupled to the second end 276 of the boom 252.

The second hydraulic cylinder 16 is associated with attachment 251. As shown in FIG. 2, a linkage links or operably connects the second hydraulic cylinder 16 to the attachment 251, although other configurations are possible and fall within the scope of the claims. The second hydraulic cylinder 16 is arranged to move the attachment 251 by changing a linear position (e.g., second linear position) of a movable member (e.g., rod or piston) of the second hydraulic cylinder 16. To move the boom 252 or hold the attachment 251 in a desired position, the controller 20 sends a control signal or control data to the second electrical control interface 17. The second electrical control interface 17 may comprise an electromechanical valve, an actuator, a servo-motor, a solenoid or another electrically controlled device for controlling or regulating hydraulic fluid associated with the second hydraulic cylinder 16. A second sensor 18 detects an attachment angle of attachment 251 with respect to the boom 252 or detects the linear position of a movable member associated with the second hydraulic cylinder 16.

The first sensor 14 and the second sensor 18 may be implemented in various alternative configurations. Under a first example, the first sensor 14, the second sensor 18, or both comprise potentiometers or rotary potentiometers that change resistance with a change in an angular position. Rotary potentiometers may be mounted at or near joints or hinge points, such as where the attachment 251 rotates with respect to the boom 252, or where the boom 252 rotates with respect to another structure (e.g., 277) of the vehicle.

Under a second example, the first sensor 14, the second sensor 18, or both comprise linear potentiometers that change resistance with a corresponding change in linear position. In one embodiment, a rod of a hydraulic cylinder (e.g., first hydraulic cylinder 12 or second hydraulic cylinder 16) may be hollow to accommodate the mounting of a linear potentiometer therein. For example, the hollow rod may be equipped with a variable resistor with a wiper, or variable resistor with an electrical contact that changes resistance with rod position.

Under a third example, the first sensor 14, the second sensor 18 or both may comprise magnetostrictive sensors, a magnetoresistive sensor, or magnetic sensor that changes resistance or another electrical property in response to a change in magnetic field induced by a permanent magnet or an electromagnet. The magnetic sensor and a magnet or electromagnet may be mounted on different members near a hinge points to detect relative rotational or angular displacement of the members. Alternately, the magnet or electromagnet may be associated with or mounted on a movable member of the hydraulic cylinder (e.g., the first hydraulic cylinder 12 or the second hydraulic cylinder 16.)

Under a fourth example, the first sensor 14, the second sensor 18 or both may comprise analog sensors, digital sensors, or other sensors for detecting an angular position (e.g., of the boom 252 or the attachment 251) over a defined range. Analog sensors may support continuous position information over the defined range, whereas the digital sensor may support discrete position information within the defined range. If the digital sensor (e.g., limit switch or reed switch) only provides a two-state output indicating the boom or attachment is in desired position or not in a desired position, such a digital sensor alone is not well-suited for maintaining a desired or graduated movement versus time curve.

Under a fifth example, the first sensor 14, the second sensor 18 or both comprise ultrasonic position detectors, magnetic position detectors, or optical position detectors, or other sensors for detecting a linear position of a movable member of the first hydraulic cylinder 12, the second hydraulic cylinder 16, or both.

In a sixth example, the first sensor 14 is integrated into the first hydraulic cylinder 12. For example, the first hydraulic cylinder 12 comprises a cylinder rod with a magnetic layer and the first sensor 14 senses a first magnetic field (or a digital or analog recording) recorded on the magnetic layer to estimate the boom angle. Similarly, the second sensor 18 is integrated into the second hydraulic cylinder 16. In such a case, the second hydraulic cylinder 12 may comprise a cylinder rod with a magnetic layer, where the second sensor 18 senses a second magnetic field (or a digital or analog recording) recorded on the magnetic layer to estimate the attachment angle.

In an seventh example, the first sensor 14 and the second sensor 18 each are integrated into a hydraulic cylinder (e.g., first hydraulic cylinder 12 or the second hydraulic cylinder 16) with a hollow rod. For example, the hollow rod may be associated with an ultrasonic position detector that transmits an ultrasonic wave or acoustic wave and measures the time of travel associated with its reflection or another property of ultrasonic, acoustic or electromagnetic propagation of the wave within the hollow rod.

In a eighth example, the first sensor 14 comprises a linear position sensor mounted in tandem with the first hydraulic cylinder 12, and the second sensor 18 comprises a linear position sensor mounted in tandem with the second hydraulic cylinder 16. In the eighth example, the linear position sensor may comprise one or more of the following: a position sensor, an angular position sensor, a magnetostrictive sensor, a magnetoresistive sensor, a resistance sensor, a potentiometer, an ultrasonic sensor, a magnetic sensor, and an optical sensor.

For any of the above examples, the first position sensor 14 or the second position sensor 18 may be associated with a protective shield. For instance, for a linear position sensor mounted in tandem with the first hydraulic cylinder 12 or the second hydraulic cylinder 16, the protective shield may comprise a cage, a frame, metallic mesh, a longitudinal metal member with two longitudinal seams or folds, or another protective shield. The protective shield extends in a longitudinal direction and may be connected or attached to at least a portion of the first hydraulic cylinder 12 or the second hydraulic cylinder 16.

In an alternate embodiment, the protective shield is telescopic, has bellows, or is otherwise made of two movable members that engage each other. Accordingly, such a protective shield may be connected to both ends of the respective hydraulic member, or any supporting structures, associated therewith or adjacent thereto.

In one embodiment, the user interface 22 comprises one or more switches for accepting a command to enter a ready position state (e.g., return-to-dig position) or a preset position state from another position state (e.g., dump position, curl position, or another operational position). The ready position state may comprise a preset position state that is associated with one or more of the following: a target boom angular range, a boom angle, a target attachment angular range, and an attachment angle that is established, programmed selected, or entered by an operator via the user interface 22 to meet the requirements of a particular work task (e.g., digging) for the vehicle. The command may refer to the activation or deactivation of the switch by an operator. For example, if the switch comprises a joystick controller 20, in one embodiment the command is initiated by moving a handle of the joystick controller 20 to a defined detent position for a minimum duration. The operator may establish or select the boom angle or target boom angular range via an entry or input into the user interface 22. For example, the operator may enter or select a desired ready height of the attachment, a default or factory setting for the desired ready height of the attachment, or a target boom angular range. The target boom angular range may be based on the desired ready height of the attachment defined by the operator. The user interface 22, the controller 20, or both may comprise a limiter 19 for limiting the desired ready height to an upper height limit. Further, the limiter 19 may limit the desired ready height to a range between an upper height limit and a lower height limit. The limiter 19 may limit the upper limit height to prepare for another work task, to prepare for digging into material, or to avoid raising the center of gravity of the work vehicle above a maximum desired level.

The controller 20 supports one or more of the following: (1) measurement or determination of position, velocity or acceleration data associated with the boom, the attachment, or both, and (2) control of the boom and the attachment via the first hydraulic cylinder and the second hydraulic cylinder, respectively, based on the at least one of the determined position, velocity and acceleration data. The foregoing functions of the controller may be carried out in accordance with various techniques, which may be applied alternately or cumulatively. Under a first technique, the controller 20 controls the first hydraulic cylinder 12 to attain a target boom angular range and controls the second cylinder to attain a target attachment angular range associated with the ready position state in response to the command. Under a second technique, the controller 20 controls the first hydraulic cylinder 12 to attain a target boom position and controls the second cylinder to attain a target attachment position associated with the ready position state in response to the command. Under a third technique, the controller controls the first hydraulic cylinder and the second hydraulic cylinder to move the boom and the attachment simultaneously. Under a fourth technique, the controller may determine or read a first linear position of the first cylinder, a second linear position of the second cylinder, an attachment angle between the attachment and the boom, or a boom angle between a vehicle (or a support) and the boom. Under a fifth technique, the controller may determine or read a first linear position versus time of the first cylinder (i.e., a first linear velocity), a second linear position versus time of a the second cylinder (i.e., a second linear velocity), an attachment angle versus time between the attachment and the boom (i.e., an attachment angular velocity), or a boom angle versus time between a vehicle (or a support) and the boom (i.e., a boom angular velocity). Under a sixth technique, the controller may be arranged to take a first derivative of the first linear velocity, the second linear velocity, the attachment angular velocity or the boom angular velocity to determine or estimate the acceleration of deceleration of the boom, the attachment, or both.

In FIG. 2 through FIG. 5, the work vehicle comprises a loader 250 and the attachment 251 comprises a bucket. Although the loader 250 shown has a cab 253 and wheels 254, the wheels 254 may be replaced by tracks and the cab 253 may be deleted. One or more wheels 254 or tracks of the vehicle are propelled by an internal combustion engine, an electric drive motor, or both. Although FIG. 2 through FIG. 5 illustrate the attachment 251 as a bucket, in other embodiments that attachment may comprise one or more of the following: a bucket, a loader, a grapper, jaws, claws, a cutter, a grapple, an asphalt cutter, an auger, compactor, a crusher, a feller buncher, a fork, a grinder, a hammer, a magnet, a coupler, a rake, a ripper, a drill, shears, a tree boom, a trencher, and a winch.

FIG. 2 shows side view of a loader 250 as an illustrative work vehicle, where the loader 250 is in a first ready position (e.g., first return-to-dig position). Here, the first ready position is characterized by the attachment angular range or the attachment angle 255 (θ) with respect to the boom 252 approaching zero degrees with respect to a generally horizontal axis. In other words, the first ready position of FIG. 2 illustrates the attachment 251 as a bucket, where a bottom of a bucket is in a generally horizontal position or substantially parallel to the ground. The first ready state has a target attachment angular range and a target boom angular range that are consistent with completion of a corresponding return-to-dig procedure, and the start of a new dig cycle.

Figure 3:
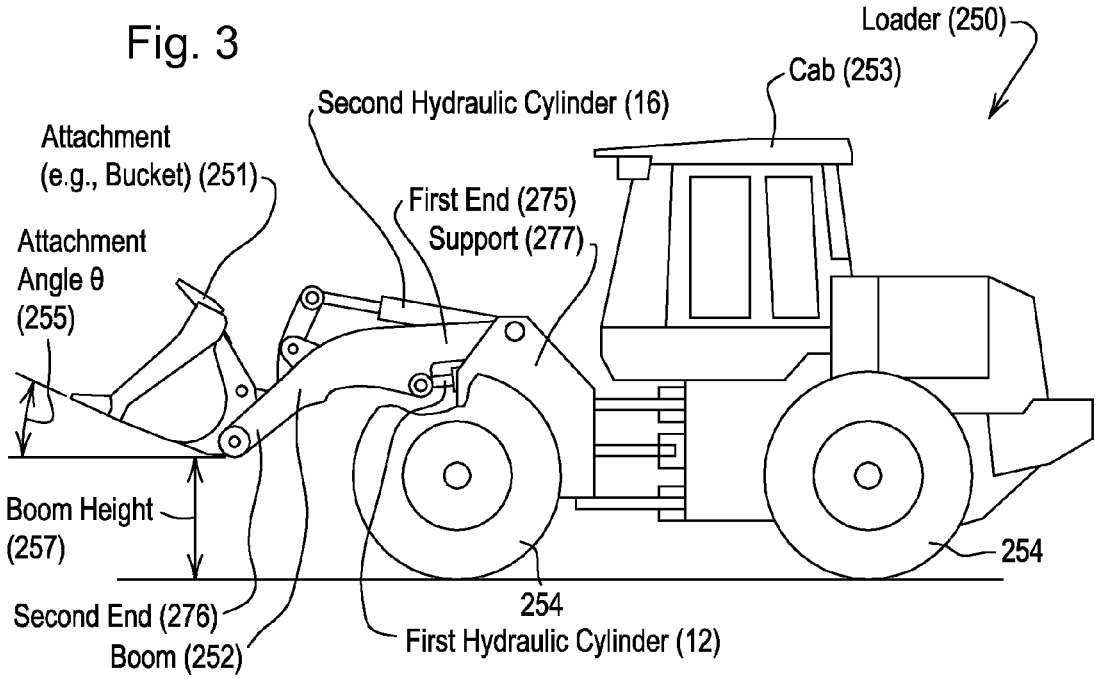
FIG. 3 is a diagram of a side view of a loader as an illustrative work vehicle, where the loader is in another ready position (e.g., return-to-dig position).

FIG. 3 shows side view of a loader 250 as an illustrative work vehicle, where the loader 250 is in a second ready position (e.g., second return-to-dig position). The second ready position of FIG. 3 represents an alternative to the first ready position of FIG. 2. Here, the second ready position is characterized by the attachment angular range or the attachment angle 255 (θ) with respect to the boom 252 which ranges from zero degrees to a maximum angle with respect to a generally horizontal axis. The operator may select the attachment angle 255 (θ) via the user interface 22 based on the particular task, the height of the pile of material, the size of the pile of material, the material density, or the operator's preferences. Similarly, the boom height 257 is any suitable height selected by an operator. The operator may select the boom height 257 based on the particular task, the height of the pile of material, the size of the pile of material, the material density, or the operator's preferences, subject to any limit imposed by the limiter 19. The second ready state has a target attachment angular range and a target boom angular range that are consistent with the second ready state associated with the completion of a return-to-dig procedure.

In FIG. 3, the target boom height is associated with the target boom angular range or target boom position, where the target boom height is greater than a minimum boom height or a ground level. The target attachment angle 255 is greater than a minimum angle or zero degrees from a horizontal reference axis (e.g., associated with ground level). The target attachment angle 255 falls within the target attachment angular range. The second ready position of FIG. 3 is not restricted to having the attachment 251 (e.g., bucket) in a generally horizontal position as in the first ready position of FIG. 2. Further, providing a slight tilt (e.g., an upward facing tilt of the mouth of the bucket) or attachment angle 255 (θ) of greater than zero may support quicker or more complete filling of the attachment 251 (e.g., bucket) because gravity may force some of the materials into the bucket, for example.

Figure 4:
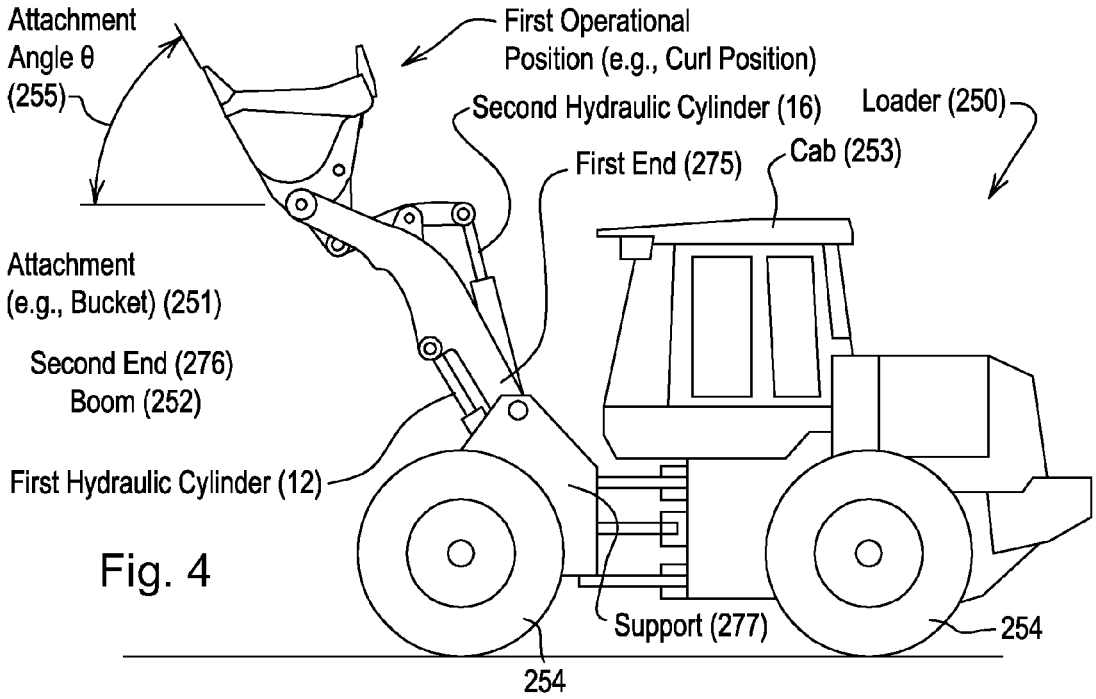
FIG. 4 is a diagram of a side view of a loader as an illustrative work vehicle, where the loader is in a first operational position (e.g., curl position).

FIG. 4 shows a side view of a loader 250 as an illustrative work vehicle, where the loader 250 is in a first operational position (e.g., curl position). The curl position typically represents a position of the attachment 251 (e.g., bucket) after the attachment 251 holds, contains, or possesses collected material. The curl position may be made immediately following a digging process or another maneuver in which the attachment 251 (e.g., bucket) is filled with material. For example, the attachment angle 255 (θ) for the curl position may be from approximately 50 degrees to approximately 60 degrees from a horizontal reference axis.

Figure 5:
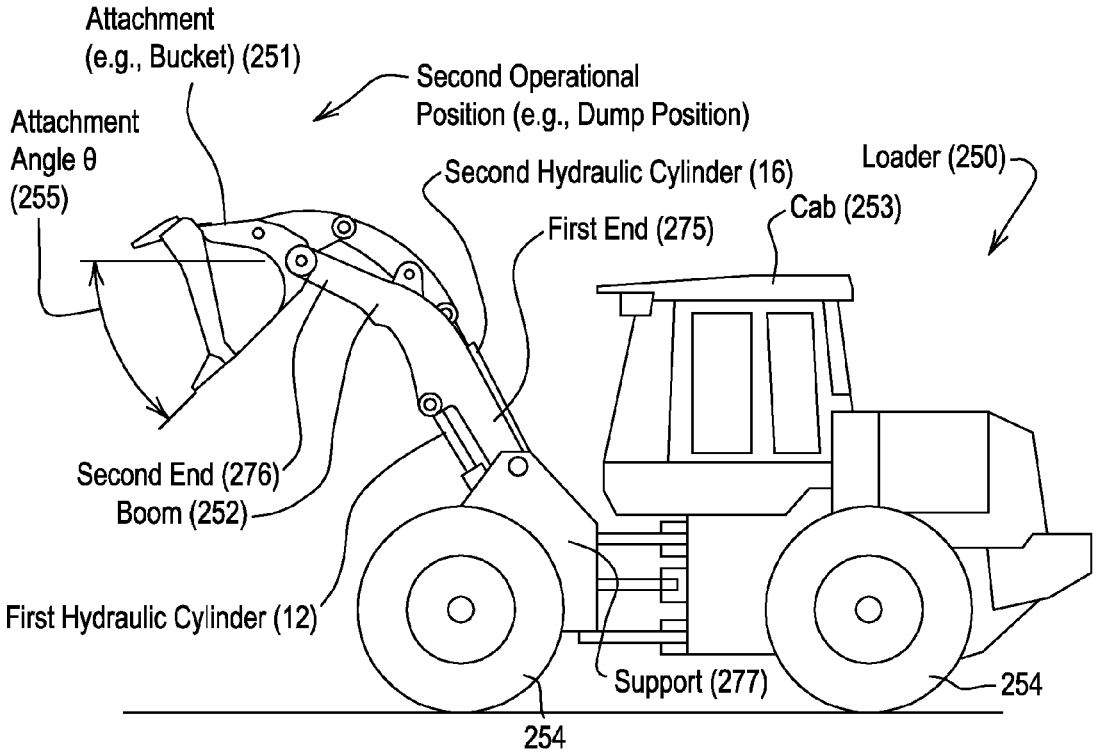
FIG. 5 is a diagram of a side view of a loader as an illustrative work vehicle, where the loader is in a second operational position (e.g., dump position).

FIG. 5 shows a side view of a loader 250 as an illustrative work vehicle, where the loader 250 is in a second operational position (e.g., dump position). The dump position may follow the curl position and is used to deposit material collected in the attachment 251 (e.g., bucket) to a desired spatial location. For example, the dump position may be used to form a pile of material on the ground or to load a dump truck, a railroad car, a ship, a hopper car, a container, a freight container, an intermodal shipping container, or a vehicle. In one example, the attachment angle 255 (θ) for the dump position may be from approximately negative thirty degrees to approximately negative forty-five degrees from a horizontal reference axis as shown in FIG. 5.

Figure 6:
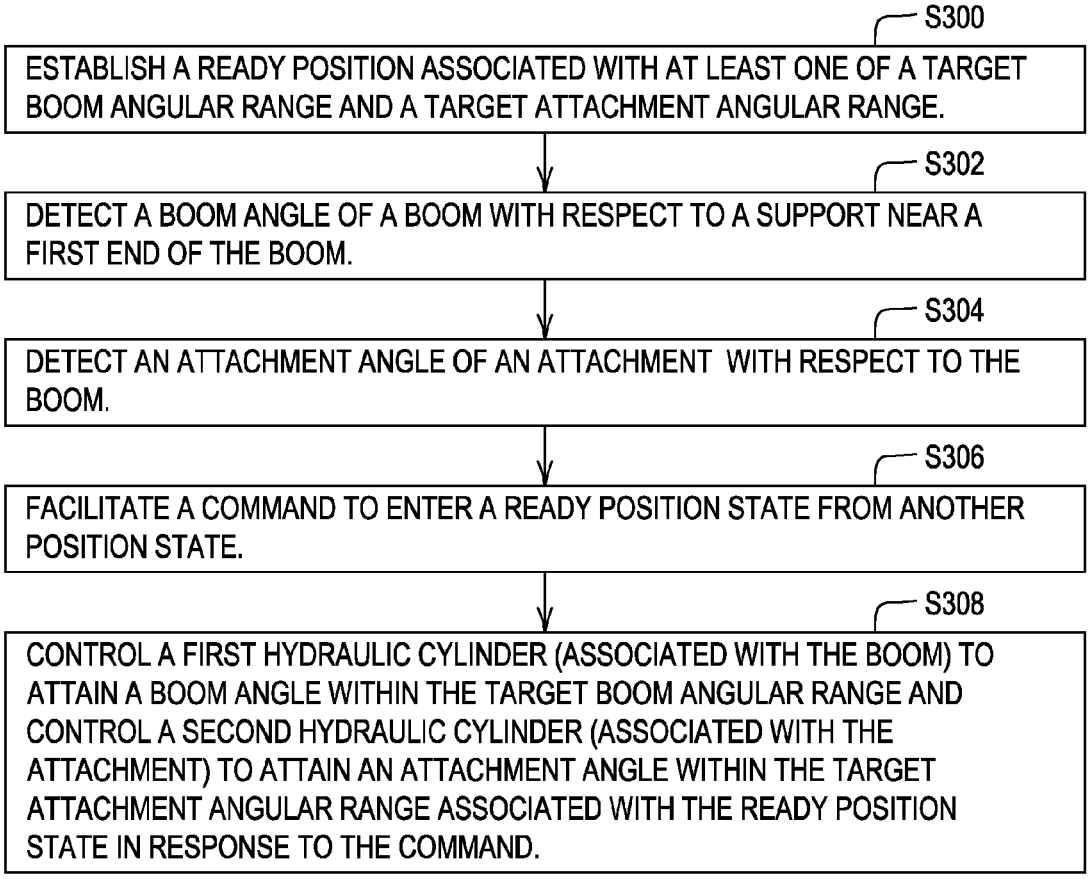
FIG. 6 is a flow chart of a first embodiment of a method for controlling a boom and attachment of a work vehicle.

FIG. 6 relates to a first embodiment of a method for controlling a boom and attachment of a work vehicle. The method of FIG. 6 begins in step S300.

In step S300, a user interface 22 or controller 20 establishes a ready position associated with at least one of a target boom angular range (e.g., target boom angle subject to an angular tolerance) of a boom and a target attachment angular range (e.g., a target attachment angle subject to an angular tolerance) of an attachment. The target boom angular range may be bounded by a lower boom angle and an upper boom angle. Because any boom angle within the target boom angular range is acceptable, the controller 20 has the possibility or flexibility of (a) decelerating the boom 252 within at least a portion of the target boom angular range (or over an angular displacement up to a limit of the target boom angular range) to achieve a desired boom motion curve (e.g., reference boom curve or compensated boom curve segment), and/or (b) shifting a stopping point of the boom for a ready position or a stationary point associated with the boom motion curve within the target boom angular range (or up to a limit of the target boom angular range). In an alternate embodiment, the target boom angular range is defined to be generally coextensive with a particular boom angle or the particular boom angle and an associated tolerance (e.g., plus or minus one tenth of a degree) about it.

The target attachment angular range may be bounded by a lower attachment angle and an upper attachment angle. Because any attachment angle within the target attachment angular range may be acceptable, the controller 20 has the possibility or flexibility of (a) decelerating the attachment 251 within at least a portion of the attachment angular range (or over an angular displacement up to a limit of the target attachment angular range) to achieve a desired attachment motion curve (e.g., a reference attachment curve or compensated attachment curve segment), and/or (b) shifting a stopping point of the attachment or a stationary point associated with the attachment motion curve within the target attachment angular range (or up to a limit of the target attachment angular range). In an alternate embodiment, the target attachment angular range is defined to be generally coextensive with a particular attachment angle alone or the particular attachment angle and an associated tolerance (e.g., plus or minus one tenth of a degree) about it.

In step S302, a first sensor 14 detects a boom angle of the boom 252 with respect to a support 277 near a first end 275 of the boom 252.

In step S304, a second sensor 18 detects an attachment angle of the attachment 251 with respect to the boom 252.

In step S306, the user interface 22 or controller 20 facilitates a command to enter a ready position from another position (e.g., curl position, dump position, operational position, task position, or digging position). For example, the user interface 22 or controller 20 may facilitate a command to enter the first ready position, the second ready position (e.g., FIG. 3), or another ready position.

In step S308, a controller 20 controls a first hydraulic cylinder 12 (associated with the boom 252) to attain a boom angle (e.g., shifted boom angle) within the target boom angular position and controls the second hydraulic cylinder 16 (associated with the attachment 251) to attain an attachment angle (e.g., a shifted attachment angle) within a target attachment angular position associated with the ready position state (e.g., first ready position or second ready position state) in response to the command. Step S308 may be carried out in accordance with various techniques, which may be applied alternately and cumulatively Under a first technique, the user interface 22 may allow a user to select an operational mode in which the shifted boom angle, the shifted attachment angle, or both are mandated or such an operational mode may be programmed as a factory setting of the controller 20, for example. The boom angle may comprise a shifted boom angle, if the controller 20 shifts the stopping point of the boom 252 within the target boom angular range. The controller 20 may shift the stopping point of the boom 252 to decelerate the boom 252 to reduce equipment vibrations, to prevent abrupt transitions to the ready state, to avoid breaching a maximum deceleration level, or to conform to a desired boom motion curve (e.g., reference boom curve), for instance. In one configuration, the controller 20 may use the shift in the stopping point to compensate for a lag time or response time of the first hydraulic cylinder 12 or the first cylinder assembly 10.

In accordance with the first technique, the attachment angle may comprise a shifted attachment angle, if the controller 20 shifts the stopping point of the attachment 251 within the attachment angular range. The controller 20 may shift the stopping point of the attachment 251 to decelerate the attachment 251 to reduce equipment vibrations, to prevent abrupt transitions to the ready state, to avoid breaching a maximum deceleration level, or to conform to a desired attachment motion curve (e.g., reference attachment curve or compensated attachment curve segment), for instance. In one configuration, the controller 20 may use the shift in the stopping point to compensate for a lag time or response time of the second hydraulic cylinder 16 or the second cylinder assembly 24.

Under a second technique, the controller 20 controls the first hydraulic cylinder 12 and the second hydraulic cylinder 16 to move the boom 252 and the attachment 251 simultaneously. Under a third technique, the controller 20 controls the first hydraulic cylinder 12 to move the boom 252 to achieve a desired boom motion curve (e.g., reference boom curve or compensated boom curve segment). The desired boom motion curve may comprise a compensated boom motion curve, or a boom motion curve where a maximum deceleration of the boom 252 is not exceeded. Under a fourth technique, the controller 20 controls the second hydraulic cylinder to move the attachment 251 to achieve a desired attachment motion curve (e.g., reference attachment curve or compensated attachment curve segment). The desired attachment motion curve may comprise a compensated attachment motion curve, or an attachment motion curve where a maximum deceleration of the attachment 251 is not exceeded.

Figure 7:
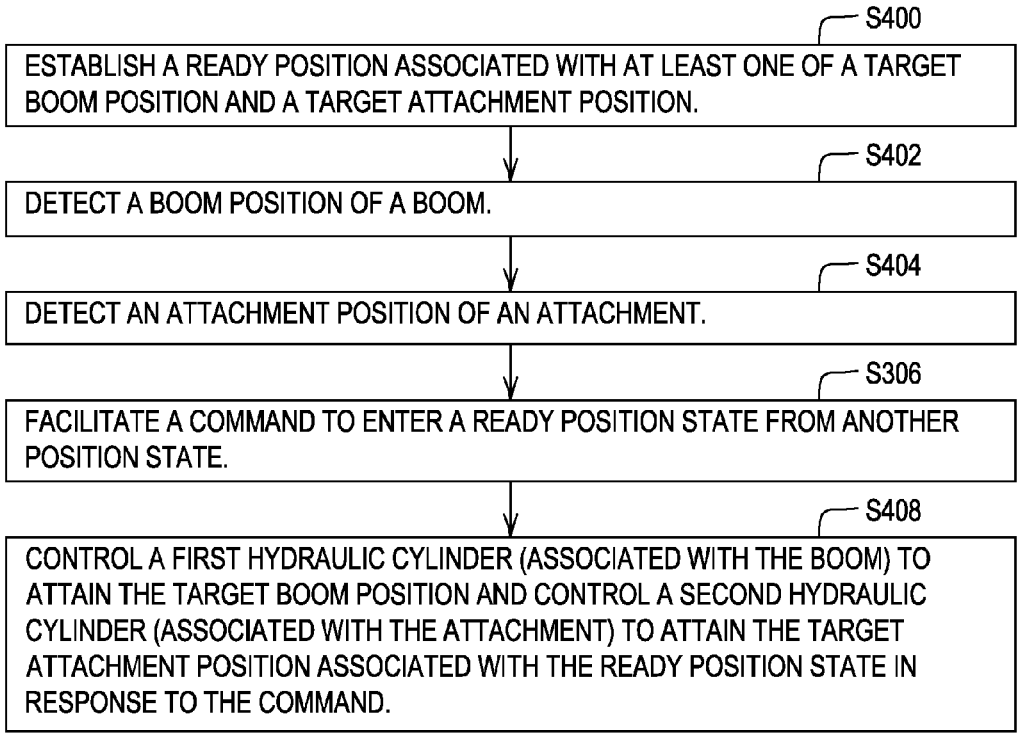
FIG. 7 is a flow chart of a second embodiment of a method for controlling a boom and an attachment of a work vehicle.

FIG. 7 relates to a second embodiment of a method for controlling a boom and attachment of a work vehicle. The method of FIG. 7 begins in step S400.

In step S400, a user interface 22 establishes a ready position associated with at least one of a target boom position and a target attachment position. The target boom position may be associated with a target boom height that is greater than a minimum boom height or ground level. The target attachment position is associated with an attachment angle greater than a minimum angle or zero degrees (e.g., a level bucket where a bottom is generally horizontal).

In step S402, a first sensor 14 detects a boom position of the boom 252 based on a first linear position of a first movable member associated with first hydraulic cylinder 12. The first movable member may comprise a piston, a rod, or another member of the first hydraulic cylinder 12, or a member of a sensor that is mechanically coupled to the piston, the rod, or the first hydraulic cylinder 12.

In step S404, a second sensor 18 detects an attachment position of the attachment 251 based on a second linear position of a second movable member associated with the second hydraulic cylinder 16. The second movable member may comprise a piston, a rod, or another member of the second hydraulic cylinder 16, or a member of a sensor that is mechanically coupled to the piston, the rod, or the second hydraulic cylinder 16.

In step S306, a user interface 22 or controller 20 facilitates a command to enter a ready position state from another position state. For example, the user interface 22 or controller 20 may facilitate a command to enter the first ready position (e.g., of FIG. 2), the second ready position (e.g., of FIG. 3), or another ready position.

In step S408, a controller 20 controls a first hydraulic cylinder 12 (associated with the boom 252) to attain the target boom position and controls the second hydraulic cylinder 16 (associated with the attachment 251) to attain a target attachment position associated with the ready position state in response to the command. Step S408 may be carried out in accordance with various techniques, which may be applied alternately and cumulatively. Under a first technique, the controller 20 controls the first hydraulic cylinder 12 and the second hydraulic cylinder 16 to move the boom 252 and the attachment 251 simultaneously. Under a second technique, the controller 20 controls the first hydraulic cylinder 12 to move the boom 252 to achieve a desired boom motion curve (e.g., reference boom curve or compensated boom motion curve). The desired boom motion curve may comprise a compensated boom motion curve, or a boom motion curve where a maximum deceleration is not exceeded. Under a third technique, the controller controls the second hydraulic cylinder to move the attachment to achieve a desired attachment motion curve. The desired attachment motion curve may comprise a compensated attachment motion curve, or an attachment motion curve where a maximum deceleration of the attachment 251 is not exceeded. Under a fourth technique, in step S408, the controller 20 controls the first hydraulic cylinder 16 to move the boom 252 to achieve a desired boom motion curve (e.g., a compensated boom motion curve); and the controller 20 controls the second hydraulic cylinder 16 to move the attachment 251 to achieve a desired attachment motion curve (e.g., a compensated attachment motion curve).

Figure 8:
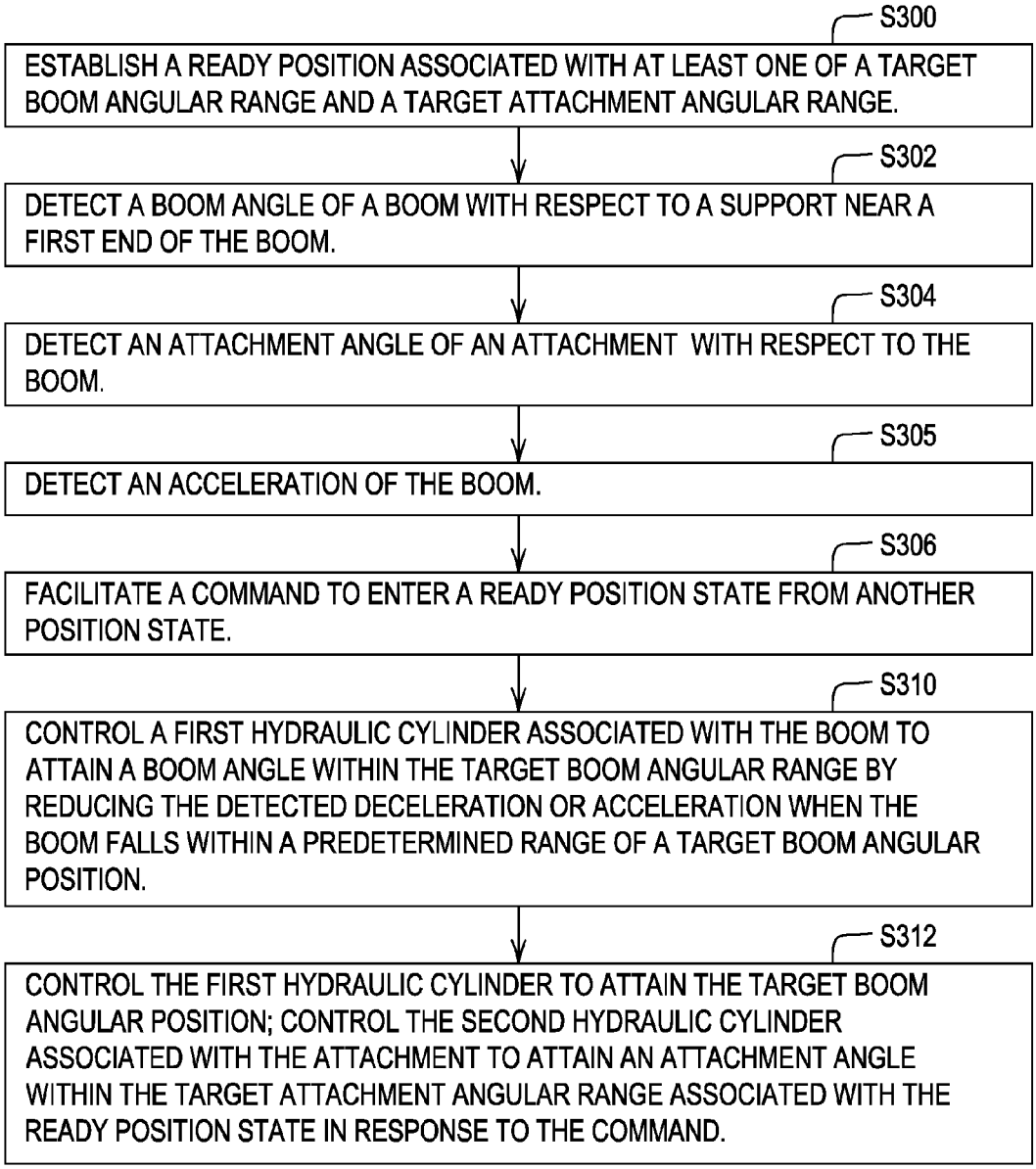
FIG. 8 is a flow chart of a third embodiment of a method for controlling a boom and an attachment of a work vehicle.

FIG. 8 relates to a second embodiment of a method for controlling a boom 252 and attachment 251 of a work vehicle. The method of FIG. 8 begins in step S300.

In step S300, a user interface 22 or controller 20 establishes a ready position associated with at least one of a target boom angular range of a boom 252 and a target angular range of an attachment 251.

In step S302, a first sensor 14 detects a boom angle of the boom 252 with respect to a support near a first end of the boom 252.

In step S304, a second sensor 18 detects an attachment angle of the attachment 251 with respect to the boom 252.

In step S305, an accelerometer or another sensor detects an acceleration of the boom 252.

In step S306, the user interface 22 or controller 20 facilitates a command to enter a ready position from another position for the boom 252 and the attachment 251. For example, the user interface 22 or controller 20 may facilitate a command to enter the first ready position, the second ready position, or another ready position.

In step S310, a controller 20 controls a first hydraulic cylinder 12 (associated with the boom 252) to attain a boom angle within the target boom angular range by reducing the detected deceleration or acceleration when the boom 252 falls within or enters within a predetermined range of the target boom angular position.

In step S312, a controller 20 controls the first hydraulic cylinder 12 to attain the target boom angular range and to control the second hydraulic cylinder 16 (associated with the attachment 251) to attain an attachment angle within the target attachment angular position associated with the ready position state in response to the command.

Figure 9:
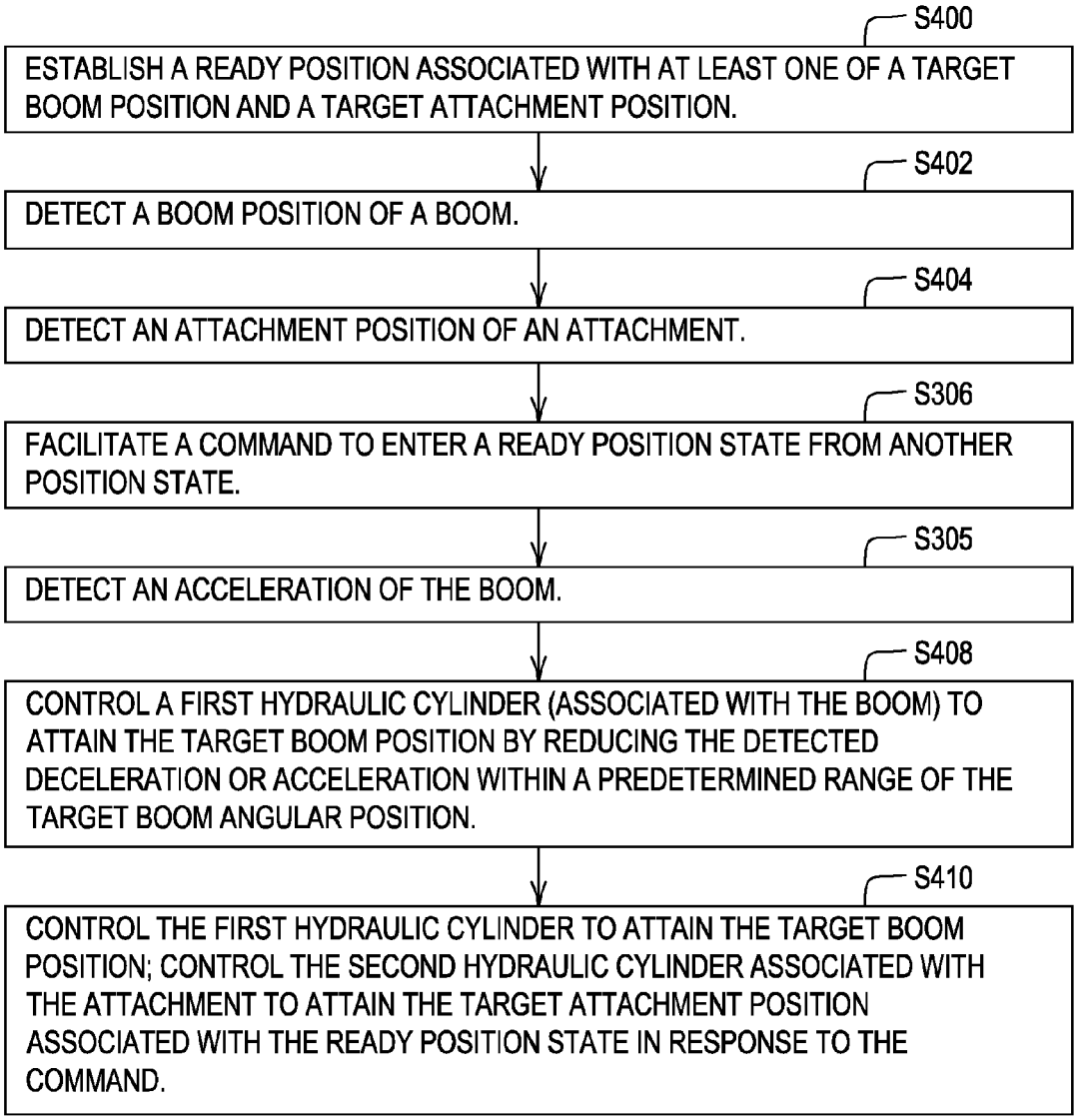
FIG. 9 is a flow chart of a fourth embodiment of a method for controlling a boom and an attachment of a work vehicle.

FIG. 9 relates to a second embodiment of a method for controlling a boom 252 and attachment 251 of a work vehicle. The method of FIG. 9 begins in step S400.

In step S400, a user interface 22 establishes a ready position associated with at least one of a target boom position and a target attachment position. The target boom position may be associated with a target boom height that is greater than a minimum boom height or ground level. The target attachment position is associated with an attachment angle greater than a minimum angle or zero degrees (e.g., a level bucket where a bottom is generally horizontal).

In step S402, a first sensor 14 detects a boom position of the boom 252. For example, a first sensor 14 detects a boom position of the boom 252 based on a first linear position of a first movable member associated with first hydraulic cylinder 12. The first movable member may comprise a piston, a rod, or another member of the first hydraulic cylinder 12, or a member of a sensor that is mechanically coupled to the piston, the rod, or the first hydraulic cylinder 12.

In step S404, a second sensor 18 detects an attachment position of the attachment based on a second linear position of a second movable member associated with the second hydraulic cylinder 16. The second movable member may comprise a piston, a rod, or another member of the second hydraulic cylinder 16, or a member of a sensor that is mechanically coupled to the piston, the rod, or the second hydraulic cylinder 16.

In step S306, a user interface 22 or controller 20 facilitates a command to enter a ready position state from another position state. For example, the user interface 22 or controller 20 may facilitate a command to enter the first ready position, the second ready position, or another ready position.

In step S305, the accelerometer or sensor detects an acceleration or deceleration of the boom.

In step S408, a controller 20 controls a first hydraulic cylinder 12 (associated with the boom 252) to attain the target boom position by reducing the detected acceleration or deceleration when the boom 252 falls within or enters within a predetermined range of the target boom angular position.

In step S410, a controller 20 controls the first hydraulic cylinder 12 to attain the target boom position of the boom 252; and controls the second hydraulic cylinder 16 (associated with the attachment 251) to attain the target attachment position associated with the ready position state in response to the command.

Figure 10:
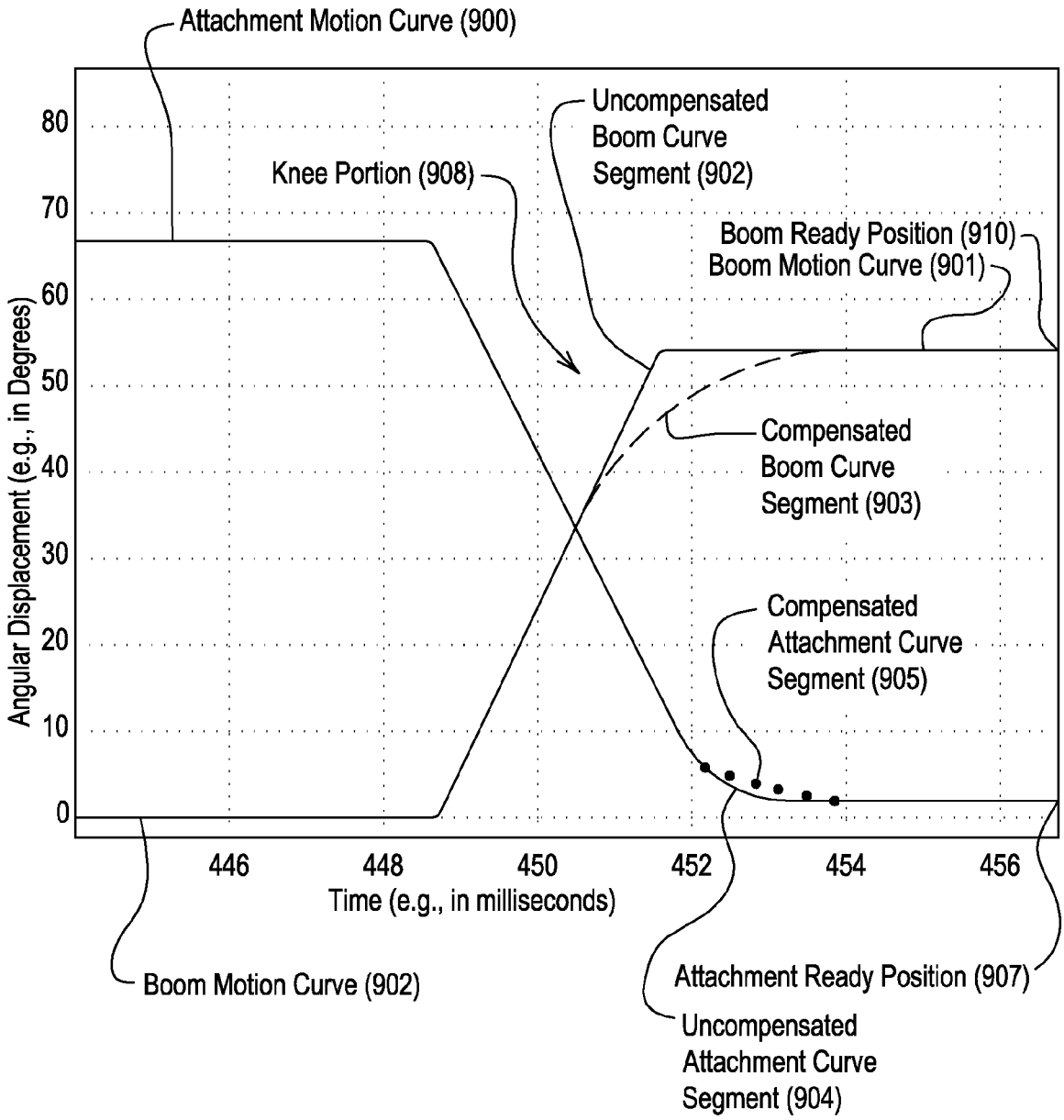
FIG. 10 is a graph of angular position versus time for a boom and angular position versus time for an attachment.

FIG. 10 is a graph of angular position versus time for a boom and angular position versus time for an attachment. The vertical axis of the graph represents angular displacement, whereas the horizontal axis of the graph represents time. For illustrative purposes, which shall not limit the scope of any claims, angular displacement is shown in degrees and time is depicted in milliseconds.

The graph shows an attachment motion curve 900 that illustrates the movement of the attachment 251 (e.g., bucket) over time. The attachment motion curve 900 has a transition from an attachment starting position (906) to an attachment ready position (907) of the attachment 251 (e.g., bucket). The controller 20 and the control system may control the movement of the attachment 251 to conform to an uncompensated attachment motion curve segment 904 in the vicinity of the transition or a compensated attachment motion curve segment 905 in the vicinity of the transition. The compensated attachment motion curve segment 905 is shown as a dotted line in FIG. 10. In one embodiment, the controller 20 uses acceleration data or an acceleration signal from an accelerometer (e.g., accelerometer 26 in FIG. 11) to control the attachment 251 to conform to the compensated attachment motion curve segment 905.

The compensated attachment motion curve segment 905 provides a smooth transition between a starting state (e.g., attachment starting position 906) and the ready state (e.g., attachment ready position 907). For example, the compensated attachment motion curve segment 905 may gradually reduce the acceleration or gradually increase the deceleration of the attachment 251 (e.g., bucket) rather than coming to an abrupt stop which creates vibrations and mechanical stress on the vehicle, or its components. The ability to reduce the acceleration or increase the deceleration may depend upon the mass or weight of the attachment 251 and its instantaneous momentum, among other things. Reduced vibration and mechanical stress is generally correlated to greater longevity of the vehicle and its constituent components.

A boom motion curve 901 illustrates the movement of the boom 252 over time. The boom motion curve 901 has a knee portion 908 that represents a transition from a boom starting position 909 to a boom ready position 910 of the boom 252. The controller 20 and the control system may control the movement of the boom 252 to conform to an uncompensated boom motion curve segment 902 in the vicinity of the knee portion 908 or a compensated boom motion curve segment 903 in the vicinity of the knee portion 908. The compensated boom motion curve segment 903 is show as dashed lines.

The compensated boom motion curve segment 903 provides a smooth transition between a starting state (e.g., boom starting position 909) and the ready state (e.g., boom ready position 910). For example, the compensated boom motion curve segment 903 may gradually reduce the acceleration of the boom 252 rather than coming to an abrupt stop which creates vibrations and mechanical stress on the vehicle, or its components. Reduced vibration and mechanical stress is generally correlated to greater longevity of the vehicle and its constituent components.

The controller 20 may store one or more of the following: the boom motion curve 901, the compensated boom motion curve segment 903, the uncompensated boom curve segment 902, the attachment motion curve 900, uncompensated attachment curve segment 904, the compensated attachment motion curve segment 905, motion curves, acceleration curves, position versus time curves, angle versus position curves or other reference curves or another representation thereof. For instance, another representation thereof may represent a data file, a look-up table, or an equation (e.g., a line equation, a quadratic equation, or a curve equation).

Figure 11:
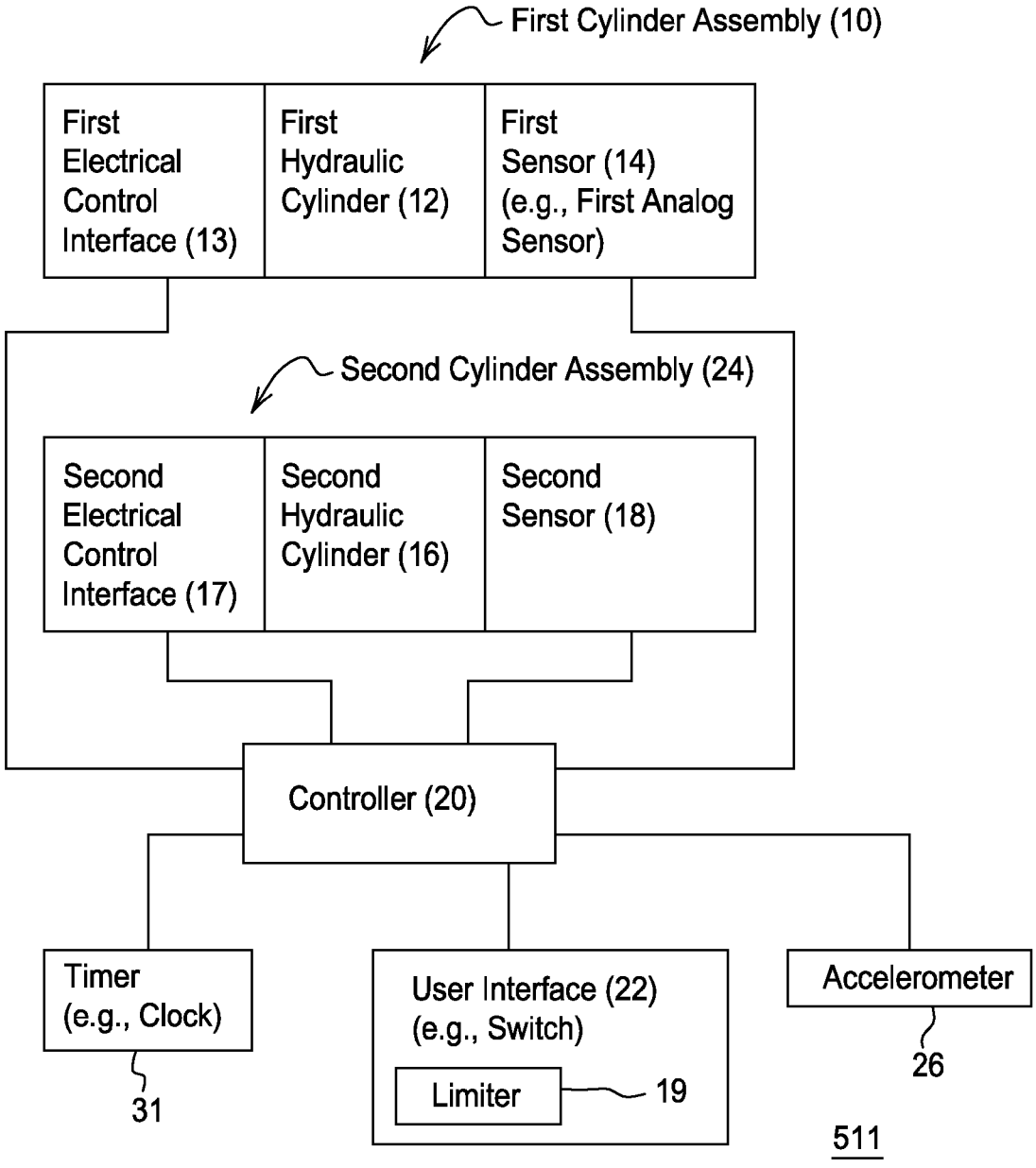
FIG. 11 is a block diagram of an alternate embodiment of a control system for a boom and attachment of a work vehicle.

The control system 511 of FIG. 11 is similar to the control system 11 of FIG. 1, except the control system 511 of FIG. 11 further includes an accelerometer 26. The accelerometer 26 is coupled to the controller 20. Like reference numbers in FIG. 1 and FIG. 11 indicate like elements. The accelerometer 26 provides an acceleration signal, a deceleration signal, acceleration data or deceleration data to the controller 20. Accordingly, the controller 20 may use the acceleration signal, acceleration data, deceleration signal, or deceleration data to compare the observed acceleration or observed deceleration to a reference acceleration data, reference deceleration data, a reference acceleration curve, a reference deceleration curve, or a reference motion curve (e.g., any motion curve of FIG. 10).

Figure 12:
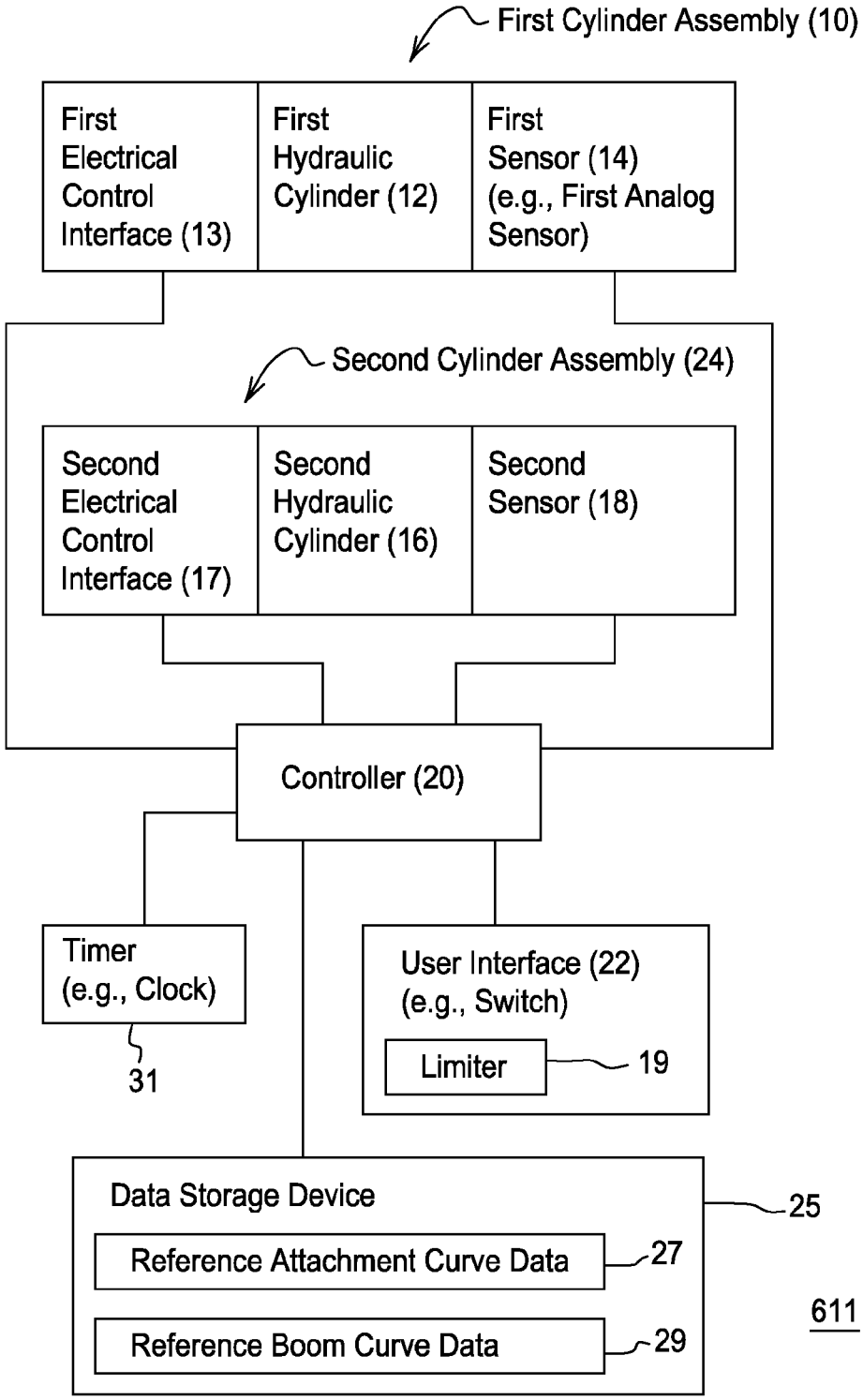
FIG. 12 is a block diagram of another alternative embodiment of a control system for a boom and an attachment of a work vehicle.

The control system 611 of FIG. 12 is similar to the control system 11 of FIG. 1, except the control system 611 of FIG. 12 further includes a data storage device 25. The data storage device 25 stores one or more of the following: reference acceleration data, reference deceleration data, a reference acceleration curve, a reference deceleration curve, a reference motion curve (e.g., any motion curve of FIG. 10), reference attachment curve data 27, reference boom curve data 29, a database, a look-up table, an equation, and any other data structure that provides equivalent information. The reference attachment curve data 27 refers to a reference attachment command curve, a reference attachment motion curve (e.g., any attachment motion curve of FIG. 10), or both. The reference attachment curve 27 stored in the data storage device 25 may comprise the attachment motion curve 900 or the compensated attachment curve segment 905 of FIG. 10, for example. The reference boom curve data 29 refers to a reference boom command curve, a reference boom motion curve (e.g., any boom motion curve of FIG. 10), or both. The reference boom curve data 29 stored in the data storage device 25 may comprise the boom motion curve 901 or the compensated boom curve segment 903 of FIG. 10, for example.

The reference boom command curve refers to a control signal that when applied to the first electrical control interface 13 of the first hydraulic cylinder 12 yields a corresponding reference boom motion curve (e.g., 901). The reference attachment command curve refers to a control signal that when applied to the second electrical control interface 17 of the second hydraulic cylinder 16 yields a corresponding reference attachment motion curve.

The controller 20 controls the first hydraulic cylinder 12 to move the boom 252 to achieve a desired boom motion curve. In one example, the controller 20 may reference or retrieve desired boom motion curve from the data storage device 25 or a corresponding reference boom command curve stored in the data storage device 25. In another example, the controller 20 may apply a compensated boom motion curve segment, which is limited to a maximum deceleration level, a maximum acceleration level, or both, to control the boom 252.

The controller 20 controls the second hydraulic cylinder 16 to move the attachment 251 (e.g., bucket) to achieve a desired attachment motion curve. In one example, the controller 20 may reference or retrieve desired attachment motion curve from the data storage device 25 or a corresponding reference attachment command curve stored in the data storage device 25. In another example, the controller 20 may apply a compensated attachment motion curve segment, which is limited to a maximum deceleration level, a maximum acceleration level, or both, to control the attachment 251 (e.g., attachment).

Figure 13:
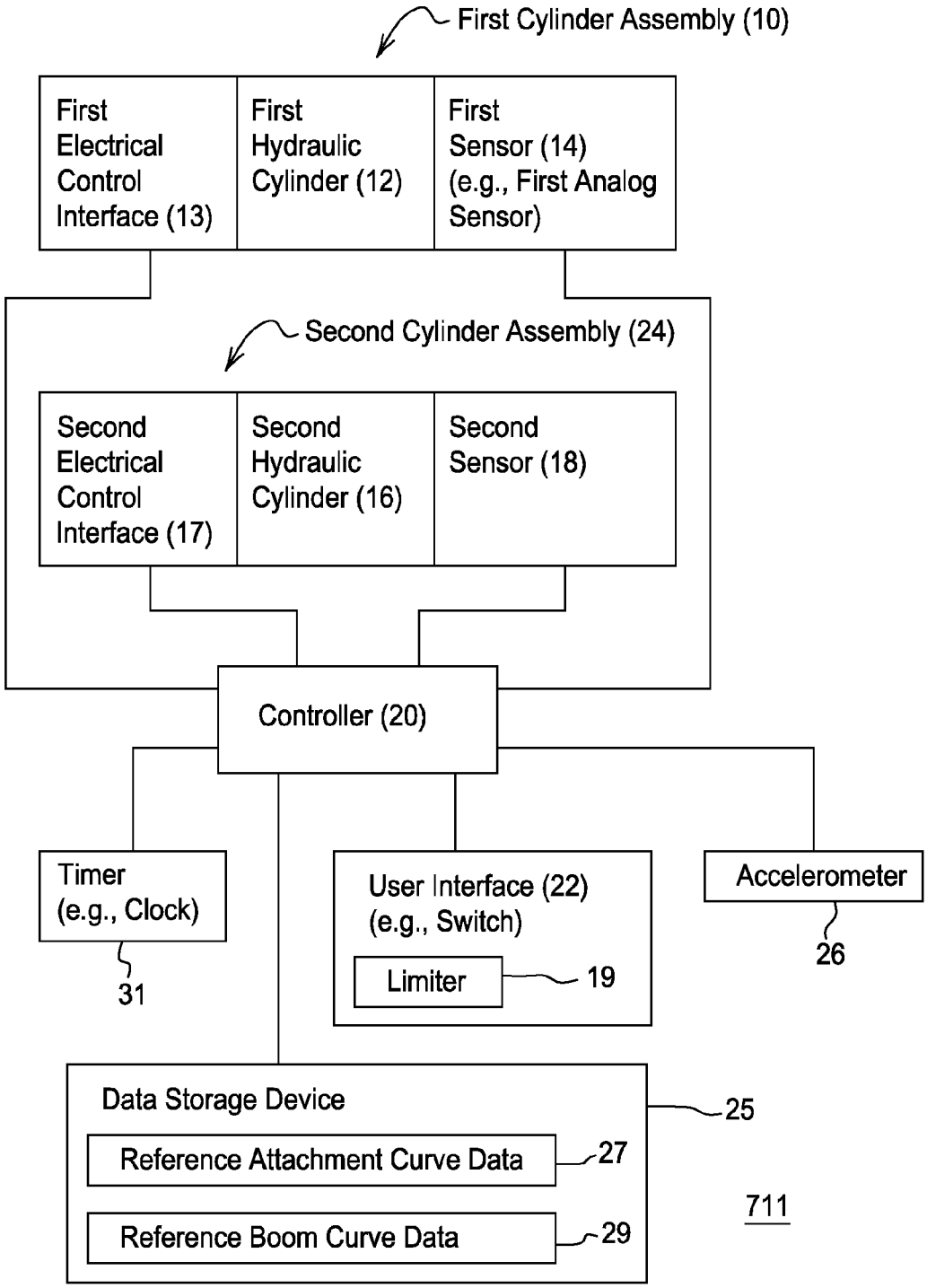
FIG. 13 is a block diagram of yet another alternative embodiment of a control system for a boom and an attachment of a work vehicle.

The control system 711 of FIG. 13 is similar to the control system 611 of FIG. 12, except the control system 711 of FIG. 13 further includes an accelerometer 26. Like reference numbers in FIG. 11, FIG. 12 and FIG. 13 indicate like elements. The accelerometer 26 provides an acceleration signal, a deceleration signal, acceleration data or deceleration data to the controller 20. Accordingly, the controller 20 may use the acceleration signal, acceleration data, deceleration signal, or deceleration data to compare the observed acceleration or observed deceleration to a reference acceleration data, reference deceleration data, a reference acceleration curve, a reference deceleration curve, or a reference motion curve (e.g., any motion curve of FIG. 10).

Having described the preferred embodiment, it will become apparent that various modifications can be made without departing from the scope of the invention as defined in the accompanying claims.

The following is claimed:

1. A system for automated operation of a work vehicle, the system comprising:

a boom having a first end and a second end opposite the first end;

a first hydraulic cylinder associated with the boom;

a first sensor for detecting a boom position based on a first linear position of a first movable member of the first hydraulic cylinder;

an attachment coupled to the second end of the boom;

a second hydraulic cylinder associated with the attachment;

a second sensor for detecting an attachment position of attachment based on a second linear position of a second movable member of the second hydraulic cylinder;

an accelerometer for detecting an acceleration or deceleration of the boom;

a switch that accepts a command to enter a ready position state from another position state, wherein the ready position state comprises a preset position state for both the boom and the attachment to meet requirements of a particular work task for the work vehicle; and a controller that controls the first hydraulic cylinder to attain a target boom position and controls the second cylinder to attain a target attachment position in response to the command in conformity with at least one of a desired boom motion curve and a desired attachment motion curve, wherein both the target boom position and the target attachment position are associated with the ready position state that comprises the preset position state such that both the target boom position and the target attachment position are automatically attained responsive to the command to enter the ready position state without further command from an operator of the work vehicle.

2. The system according to claim 1 wherein a target boom height is associated with the target boom position, wherein the target boom height is greater than a minimum boom height or a ground level, and wherein the target attachment position is associated with an attachment angle greater than a minimum angle or zero degrees.

3. The system according to claim 1 further comprising:

a data storage device comprising a reference boom command curve and a reference attachment command curve, wherein the reference boom command curve and the reference attachment command curve are accessed by the controller and used to move the boom to the target boom position and to move the attachment to the target attachment position.

4. The system according to claim 1 wherein the controller controls the first hydraulic cylinder and the second hydraulic cylinder to move the boom and the attachment simultaneously without further command by the operator of the work vehicle.

5. The system according to claim 1 wherein the controller controls the first hydraulic cylinder to move the boom to achieve a desired boom motion curve stored in a data storage device that is consistent with the detected deceleration of the boom.

6. The system according to claim 5 wherein the target boom position is attained by reducing the detected acceleration when the boom falls within a predetermined range of the target boom position, and wherein the boom does not exceed a maximum deceleration in accordance with the desired boom motion curve.

7. The system according to claim 1 wherein the controller controls the second hydraulic cylinder to move the attachment to achieve a desired attachment motion curve stored in a data storage device that is consistent with the detected deceleration of the boom.

8. The system according to claim 7 wherein the attachment does not exceed a maximum deceleration in accordance with the desired attachment motion curve.

9. The system according to claim 1 wherein the attachment comprises one of the following: a bucket, a loader, a grapper, jaws, claws, a cutter, a grapple, an asphalt cutter, an auger, compactor, a crusher, a feller buncher, a fork, a grinder, a hammer, a magnet, a coupler, a rake, a ripper, a drill, shears, a tree boom, a trencher, and a winch.

10. The system according to claim 1 wherein the boom position is selected based on a desired ready height of the attachment previously defined by the operator.

11. The system according to claim 10 further comprising:

a limiter for limits the desired ready height to an upper height limit.

12. The system according to claim 10 further comprising:

a limiter for limits the desired ready height to a range between an upper height limit and a lower height limit.

13. The system according to claim 1 wherein the first sensor and the second sensor each comprise one of the following: a position sensor, an angular position sensor, a magnetostrictive sensor, a resistance sensor, a potentiometer, a rheostat, an ultrasonic sensor, a magnetic sensor, and an optical sensor.

14. The system according to claim 1 wherein the attachment comprises a bucket and wherein the target attachment position and a target boom position is consistent with a respective ready state associated with completion of a corresponding return-to-dig procedure to start a new dig cycle.

15. A method for automated operation of a work vehicle, the method comprising:

establishing a ready position associated with at least one of a target boom position and a target attachment position;

detecting a boom position of the boom based on a linear position of a movable member associated with a first hydraulic cylinder;

detecting an attachment position of the attachment based on a linear position of a movable member associated with a second hydraulic cylinder;

detecting an acceleration of the boom;

facilitating a command to enter a ready position state from another position state;

controlling the first hydraulic cylinder associated with the boom to attain the target boom position by reducing the detected acceleration when the boom falls within a predetermined range of the target boom position; and controlling the second hydraulic cylinder associated with the attachment to attain the target attachment position associated with the ready position state in response to the command.

16. The method according to claim 15 wherein a target boom height is associated with the target boom position, wherein the target boom height is greater than a minimum boom height, and wherein the target attachment position is associated with an attachment angle greater than a minimum angle or zero degrees.

17. The method according to claim 15 further comprising: a data storage device comprising a reference boom command curve and a reference attachment command curve, wherein the reference boom command curve and the reference attachment command curve are accessed by the controller and used to move the boom to achieve a desired boom motion curve and to move the attachment to achieve a desired attachment motion curve.

18. The method according to claim 15 wherein the controlling comprises controlling the first hydraulic cylinder and the second hydraulic cylinder to move the boom and the attachment simultaneously without further command by an operator of the work vehicle.

19. The method according to claim 15 wherein the controlling comprises controlling the first hydraulic cylinder to move the boom to achieve a desired boom motion curve stored in a data storage device that is consistent with the detected deceleration of the boom.

20. The system according to claim 19 wherein the boom does not exceed a maximum deceleration in accordance with the desired boom motion curve.

21. The method according to claim 15 wherein the controlling comprises controlling the second hydraulic cylinder to move the attachment to achieve a desired attachment motion curve stored in a data storage device that is consistent with the detected deceleration of the boom.

22. The system according to claim 21 wherein the attachment does not exceed a maximum deceleration in accordance with the desired attachment motion curve.

23. The method according to claim 15 wherein a boom angle is selected based on a desired ready height of the attachment previously defined by the operator.

24. The method according to claim 23 further comprising: limiting the desired ready height to an upper height limit.

25. The method according to claim 23 further comprising limiting the desired ready height to a range between an upper height limit and a lower height limit.

26. The method according to claim 15 wherein the attachment comprises a bucket and wherein the target attachment position and a target boom position is consistent with a respective ready state associated with completion of a corresponding return-to-dig procedure to start a new dig cycle.

27. The method according to claim 15 wherein the ready position is established by one of program selected and entered by the operator of the work vehicle.

* * * * *